US011445877B2

(12) United States Patent
Liu

(10) Patent No.: US 11,445,877 B2
(45) Date of Patent: Sep. 20, 2022

(54) DUST COLLECTOR, VACUUM CLEANER, AND SELF-PROPELLED VACUUM CLEANER

(71) Applicant: Nidec Corporation, Kyoto (JP)

(72) Inventor: Chun-Hsien Liu, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 154 days.

(21) Appl. No.: 16/893,493

(22) Filed: Jun. 5, 2020

(65) Prior Publication Data

US 2020/0390303 A1 Dec. 17, 2020

(30) Foreign Application Priority Data

Jun. 14, 2019 (JP) ..... JP2019-110896

(51) Int. Cl.
*A47L 9/10* (2006.01)
*A47L 9/02* (2006.01)
*A47L 9/00* (2006.01)

(52) U.S. Cl.
CPC ..... *A47L 9/102* (2013.01); *A47L 9/02* (2013.01); *A47L 9/009* (2013.01)

(58) Field of Classification Search
CPC . A47L 9/102; A47L 9/02; A47L 9/009; A47L 9/1666; A47L 9/165
USPC ..... 15/352
See application file for complete search history.

(56) References Cited

U.S. PATENT DOCUMENTS 2,242,277 A * 5/1941 Yonkers, Jr. ..... A47L 9/102 55/293
2011/0225765 A1* 9/2011 Liu ..... A47L 9/1666 15/347
2017/0332868 A1* 11/2017 Nam ..... A47L 9/04

FOREIGN PATENT DOCUMENTS

JP 2011-010823 A 1/2011
JP 2011-010929 A 1/2011
JP 2017-109091 A 6/2017

* cited by examiner

*Primary Examiner* — Joseph J Hail
*Assistant Examiner* — Robert C Moore
(74) *Attorney, Agent, or Firm* — Keating & Bennett

(57) ABSTRACT

In a dust collector, an intake side surface on the intake portion side of a filter expands in a first direction, and extends in a direction including at least a component of a second direction. The housing of the dust collector includes a wall that defines an intake passage. The intake passage extends from the intake portion side to the filter side. One end of the intake passage is linked to the outside of the housing via the intake portion. Another end of the intake passage opposes a top surface side region of the intake side surface of the filter in a third direction perpendicular or substantially perpendicular to the first direction and the second direction. When viewed from the first direction, the top surface side region approaches the another end of the intake passage as it approaches the top surface side in the second direction.

10 Claims, 4 Drawing Sheets

DUST COLLECTOR, VACUUM CLEANER, AND SELF-PROPELLED VACUUM CLEANER

CROSS REFERENCE TO RELATED APPLICATION

The present application claims priority under 35 U.S.C. § 119 to Japanese Application No. 2019-110896 filed on Jun. 14, 2019, the entire contents of which are incorporated herein by reference.

1. FIELD OF THE INVENTION

The present disclosure relates to a dust collector, a vacuum cleaner, and a self-propelled vacuum cleaner.

2. BACKGROUND

A vacuum cleaner having a dust collector that collects dust contained in sucked air with a filter is known. For example, the vacuum cleaner includes a dust collection unit having a main filter and a pre-filter. The main filter separates fine dust from the air. The pre-filter separates coarse dust from the air. In the main filter, a very fine filter such as a PTFE membrane is fixed in a pleated shape with a molded resin. In the pre-filter, a mesh cloth made of polyester or the like is fixed with a molded resin. The pre-filter is rotatably pivoted by a pre-filter bearing provided to the main filter, and is urged in a direction away from the main filter. When the air containing dust is sucked from the suction port with the operation of the electric blower, the pre-filter is sucked toward the main filter. On the other hand, when the electric blower stops, the pre-filter separates from the main filter and collides with the pre-filter receiving portion. Due to the impact at that time, dust adhering to the pre-filter falls off the pre-filter and is removed.

However, in the above-described vacuum cleaner, when the air containing dust passes through the main filter, the dust tends to accumulate on the surface on the suction port side of the main filter. Therefore, there is a possibility that the main filter is easily clogged.

SUMMARY

A dust collector according to an example embodiment of the present disclosure includes a filter and a housing that houses the filter. The housing is provided with an intake portion and an exhaust portion. The exhaust portion is fluidly connected to the intake portion via the filter inside the housing. An intake side surface on the intake portion side of the filter expands in a first direction perpendicular to a direction from a top surface to a bottom surface among the inner surfaces of the housing, and extends in a direction including at least a component of a second direction parallel or substantially parallel to the direction from the top surface to the bottom surface among the inner surfaces of the housing. The housing includes a wall defining an intake passage. The intake passage extends from the intake portion side toward the filter side. One end of the intake passage is linked to the outside of the housing via the intake portion. Another end of the intake passage opposes a top surface side region of the intake side surface of the filter in a third direction perpendicular or substantially perpendicular to the first direction and the second direction. When viewed from the first direction, the top surface side region of the intake side surface approaches the other end of the intake passage as it approaches the top surface side in the second direction.

The above and other elements, features, steps, characteristics and advantages of the present disclosure will become more apparent from the following detailed description of the example embodiments with reference to the attached drawings.

DETAILED DESCRIPTION

Figure 1:
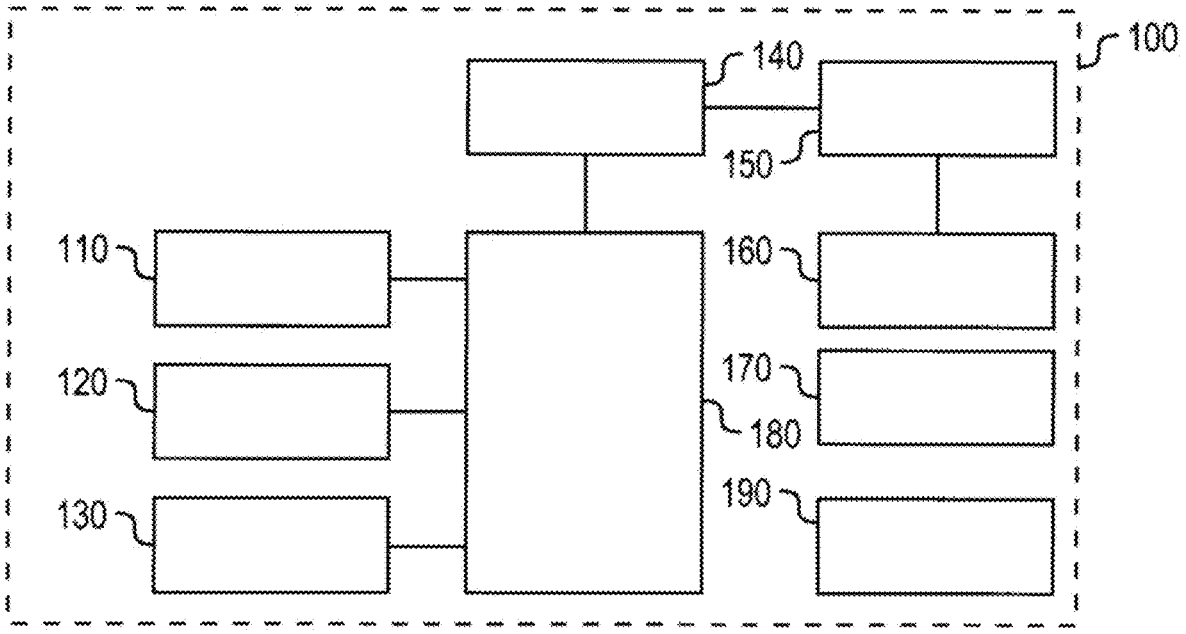
FIG. 1 is a block diagram illustrating an example configuration of a self-propelled vacuum cleaner according to an example embodiment of the present disclosure.

Hereinafter, example embodiments will be described with reference to the drawings.

In the present specification, in the positional relationship between any one of orientation, a line, and a plane and another one, "parallel" means not only a state where the two never meet no matter how long they extend, but also a state substantially parallel to each other. The terms "vertical" and "orthogonal" include not only a state where they intersect at 90 degrees with each other, but also a state where they are substantially vertical and a state where they are substantially orthogonal. That is, "parallel", "vertical", and "orthogonal" each include a state where the positional relationship between them has an angle deviation that does not depart from the gist of the present disclosure.

In this specification, a surface F to be cleaned is parallel to a horizontal plane. A direction from the surface F to be cleaned F to a dust collector 111 is "vertically upward", and a direction from the dust collector 111 to the surface F to be cleaned is "vertically downward".

In the present specification, in the dust collector 111 mounted on a self-propelled vacuum cleaner 100, among inner surfaces of a housing 3 described later, a surface facing vertically downward is referred to as a "top surface 3*a*" and a surface facing vertically upward is referred to as a "bottom surface 3*b*".

In the present specification, in the dust collector 111, a surface on an intake portion 301 side of a filter 1 described later is referred to as an "intake side surface 11". A surface on an exhaust portion 302 side of the filter 1 is referred to as an "exhaust side surface".

Further, in the present specification, of the directions perpendicular to the direction from the top surface 3*a* to the bottom surface 3*b*, a direction parallel to the intake side surface 11 of the filter 1 is referred to as a "first direction D1". A direction parallel to the direction from the top surface 3*a* to the bottom surface 3*b* is referred to as a "second direction D2". A direction orthogonal to both the first direction D1 and the second direction D2 is referred to as a "third direction D3". In the following example embodiments, the first direction D1 and the third direction D3 are parallel to a horizontal plane, and the second direction is parallel to a vertical direction.

The matters described above are not strictly applied when incorporated in an actual device.

Figure 2:
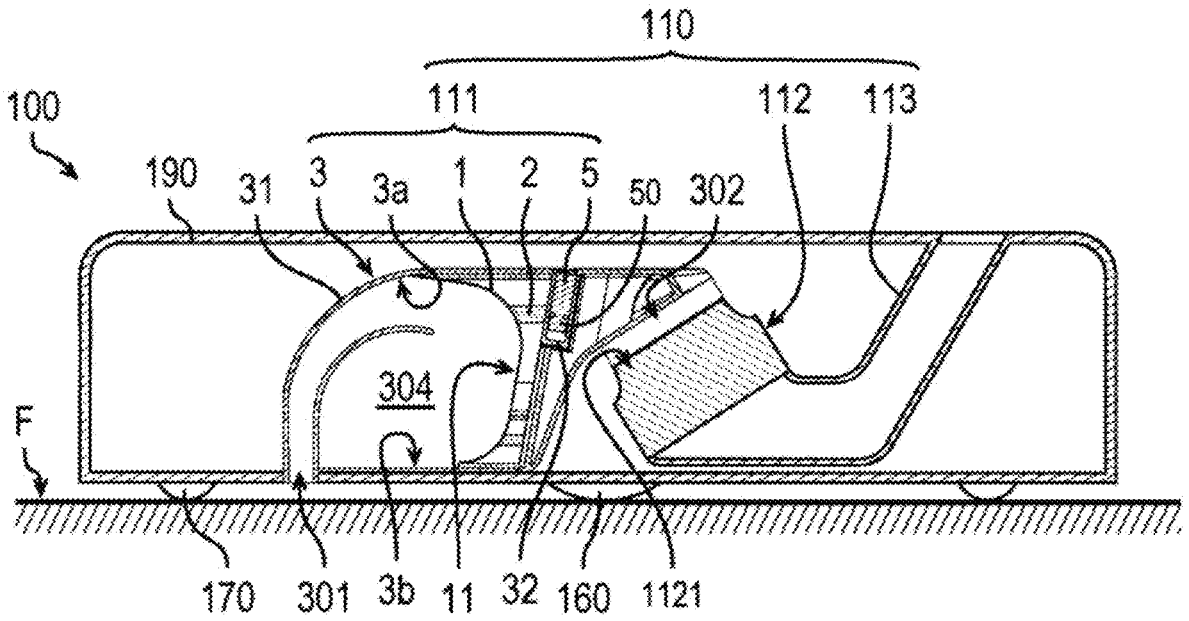
FIG. 2 is a cross-sectional view of a self-propelled vacuum cleaner according to an example embodiment of the present disclosure.

FIG. 1 is a block diagram illustrating an exemplary configuration of the self-propelled vacuum cleaner 100 according to the present example embodiment. FIG. 2 is a cross-sectional view of the self-propelled vacuum cleaner 100 according to the present example embodiment. In FIG. 1, electrically connected portions are schematically connected by solid lines, but these do not represent actual physical connection relationships. In FIG. 2, the self-propelled vacuum cleaner 100 is placed on the surface F to be cleaned.

The self-propelled vacuum cleaner 100 according to the present example embodiment is a so-called cleaning robot, for example, capable of performing self-propelled cleaning on the surface F to be cleaned.

The self-propelled vacuum cleaner 100 includes a vacuum cleaner 110, a sensor unit 120, a power supply unit 130, a drive unit 140, a motor unit 150, a main driving wheel 160, a driven wheel 170, a control unit 180, and a casing 190.

The vacuum cleaner 110 sucks and collects dust on the surface F to be cleaned together with air, for example. The vacuum cleaner 110 has a dust collector 111 and a blower 112. In other words, the self-propelled vacuum cleaner 100 includes the dust collector 111 and the blower 112. In addition, the vacuum cleaner 110 or the self-propelled vacuum cleaner 100 further includes an exhaust nozzle 113. The dust collector 111 sucks air from the intake portion 301 and separates dust from the flow of air. The separated air is discharged from the exhaust portion 302 to the outside of the dust collector 111. The blower 112 and the exhaust nozzle 113 are connected downstream of the dust collector 111. The blower 112 is connected to the exhaust portion 302, and generates a flow of air from the intake portion 301 to the exhaust portion 302 through the filter 1 in the dust collector 111. Further, the blower 112 generates a negative pressure in the exhaust portion 302 to suck the air in the dust collector 111, and discharges the air to the outside of the vacuum cleaner 110 through the exhaust nozzle 113. As the blower 112, an axial fan is employed in the present example embodiment. However, the present disclosure is not limited to this example, and other types of fans such as a centrifugal fan may be employed.

The sensor unit 120 is, for example, an infrared sensor, and detects obstacles such as walls and furniture, steps, and the like. The power supply unit 130 is, for example, a secondary battery, and supplies power to each component of the self-propelled vacuum cleaner 100. The drive unit 140 controls driving of the motor unit 150. The motor unit 150 is a driving device that drives the main driving wheel 160. The main driving wheel 160 is a wheel that causes the self-propelled vacuum cleaner 100 to travel together with the driven wheel 170. The control unit 180 controls each component of the self-propelled vacuum cleaner 100. The casing 190 accommodates therein the vacuum cleaner 110, the sensor unit 120, the power supply unit 130, the drive unit 140, the motor unit 150, the control unit 180, and the like.

Figure 3:
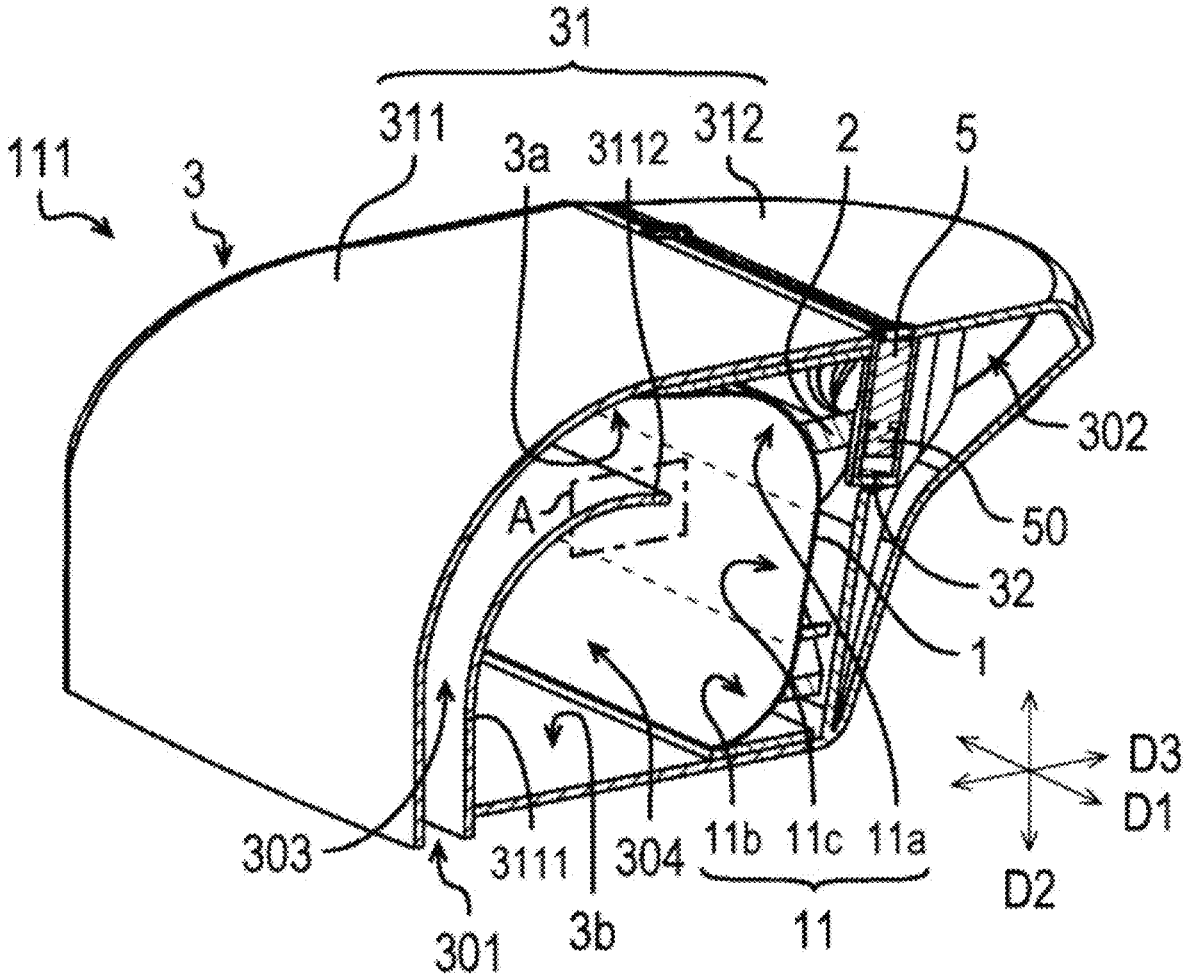
FIG. 3 is a cross-sectional perspective view of a dust collector according to an example embodiment of the present disclosure.
Figure 4:
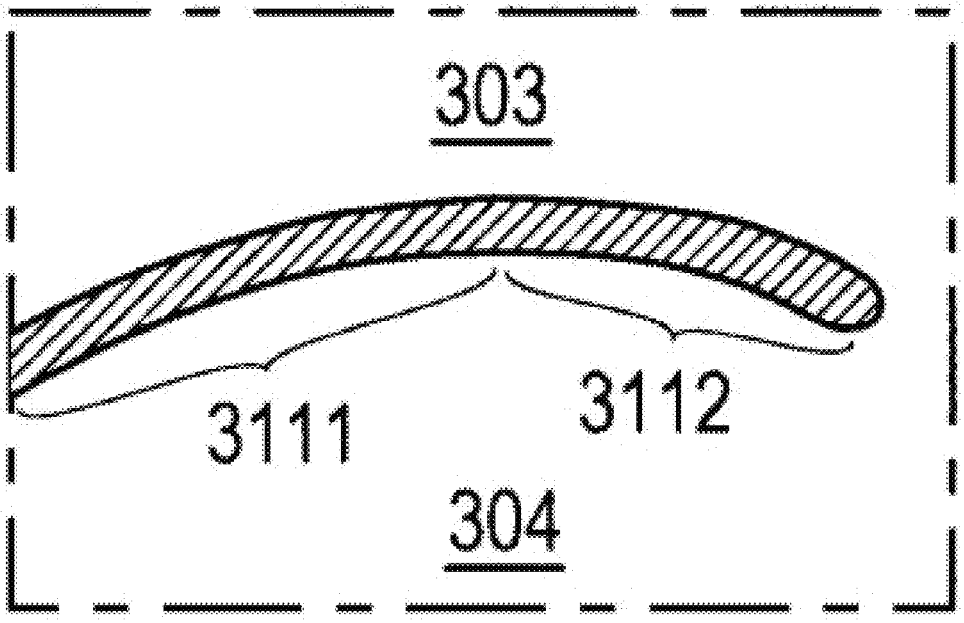
FIG. 4 is a sectional view of a portion A surrounded by a dashed line in FIG. 3.

Next, configuration of the dust collector 111 will be described with reference to FIGS. 2 to 4. FIG. 3 is a sectional perspective view of the dust collector 111 according to the present example embodiment. FIG. 4 is a sectional view of a portion A surrounded by a dashed line in FIG. 3. Note that FIG. 3 illustrates the dust collector 111 of the self-propelled vacuum cleaner 100 placed on the surface F to be cleaned.

The dust collector 111 includes the filter 1 and the housing 3. The dust collector 111 may further include a filter support 2. Moreover, the dust collector 111 may further include a vibration motor 5.

The filter 1 has air permeability and collects dust contained in the airflow passing through the filter 1. The vacuum cleaner 110 includes the filter 1. As the filter 1, for example, a high efficiency particular air filter (HEPA filter) can be adopted. The shape of the filter 1 will be described later.

The filter support 2 is housed inside the housing 3 and supports the filter 1.

The housing 3 houses the filter 1. Note that the housing 3 may further house the filter support 2. The housing 3 has a body 31 and a motor case 32. In other words, the dust collector 111 further includes the body 31 and the motor case 32.

The body 31 accommodates the filter support 2. The body 31 is provided with the intake portion 301 and the exhaust portion 302. In other words, the housing 3 is provided with the intake portion 301 and the exhaust portion 302. The intake portion 301 is an opening for taking in air from the outside of the housing 3. The exhaust portion 302 is an opening for exhausting the air to the outside of the housing 3, and is linked to the intake portion 301 via the filter 1. That is, the exhaust portion 302 is fluidly connected to the intake portion 301 via the filter 1 inside the housing 3. In the present example embodiment, a suction port 1121 of the blower 112 is connected to the exhaust portion 302.

The body 31 has a first body 311 provided with the intake portion 301 and a second body 312 provided with the exhaust portion 302.

The first body 311 is provided detachably from the second body 312. The filter 1 and the filter support 2 are detachably mounted inside the first body 311. The first body 311 can be taken out of the self-propelled vacuum cleaner 100.

Inside the first body 311, an intake passage 303 and a dust collection chamber 304 are provided. One end of the intake passage 303 is linked to the outside of the housing 3 via the intake portion 301. Further, the one end of the intake passage 303 is linked to the outside of the self-propelled vacuum cleaner 100. The other end of the intake passage 303 is linked to the dust collection chamber 304. The dust collection chamber 304 is provided upstream of the filter 1 on the intake portion 301 side. In the dust collection chamber 304, at least part of the dust separated from the airflow by the filter 1 is accumulated.

Further, the first body 311 has a partition wall 3111 and a guide plate 3112. In other words, the housing 3 has the partition wall 3111 and the guide plate 3112.

The partition wall 3111 is a wall extending from the intake portion 301 side toward the filter 1 side and forms the intake passage 303. That is, the housing 3 has a wall that forms the intake passage 303 extending from the intake portion 301 side toward the filter 1 side. In the present example embodiment, the partition wall 3111 extends from a part of the periphery of the intake portion 301, and separates the intake passage 303 from the dust collection chamber 304. The partition wall 3111 also forms the intake passage 303 together with the top surface 3*a* of the housing 3. However, the present disclosure is not limited to the example of the present example embodiment, and the partition wall 3111 may extend from the periphery of the intake portion 301 to form the intake passage 303 independently. That is, for example, the partition wall 3111 may extend in a cylindrical shape, and the partition wall 3111 may form the intake passage 303 independently. Alternatively, the partition wall 3111 may form the intake passage 303 together with a member other than the top surface 3*a*. That is, for example, another member may be disposed inside the top surface 3*a*, and such member and the partition wall 3111 may form the intake passage 303.

The guide plate 3112 extends from the tip of the partition wall 3111 toward the intake side surface 11 of the filter 1. In the present example embodiment, the guide plate 3112 extends to the inside of the dust collection chamber 304. The guide plate 3112 guides the airflow flowing through the intake passage 303 to the intake side surface 11 of the filter 1. As shown in FIG. 4 illustrating an exemplary configuration of the guide plate 3112, the guide plate 3112 is curved when viewed from the first direction D1. The center of curvature of the guide plate 3112 is located closer to the bottom surface 3*b* of the housing 3 than the guide plate 3112 in the second direction D2, and is closer to the intake portion 301 than the tip on the exhaust portion 302 side of the guide plate 3112 in the third direction D3. Thus, when the airflow is sent from the other end of the intake passage 303, turbulence is less likely to occur near the guide plate 3112.

Next, the motor case 32 is cylindrical and accommodates the vibration motor 5. The motor case 32 protrudes from an inner surface of the body 31. In the present example embodiment, the motor case 32 protrudes downward from the top surface among the inner surfaces of the second body 312. Note that the present disclosure is not limited to the example of the present example embodiment, and the motor case 32 may protrude upward from the bottom surface among the inner surfaces of the second body 312. Alternatively, the motor case 32 may protrude from a side surface among the inner surfaces of the second body 312 in a direction intersecting the vertical direction. That is, the motor case 32 is disposed in a cantilever shape in which a root portion of the motor case 32 is connected to an inner surface of the body 31 as a fixed end. The tip of the motor case 32 is a free end. In this way, a portion on the tip side of the motor case 32 can be vibrated more largely by the vibration of the vibration motor 5.

The portion on the tip side of the motor case 32 is disposed at a position where it can come into contact with the filter support 2 when the vibration motor 5 is driven. In this way, when the vibration motor 5 is driven, the portion on the tip side of the motor case 32 comes into contact with the filter support 2 and can hit the filter support 2. Therefore, since the filter support 2 can be vibrated largely, the entire filter 1 can be efficiently vibrated, and the efficiency of removing dust from the filter 1 can be improved. Therefore, clogging of the filter 1 can be eliminated.

The number of the motor cases 32 is two in the present example embodiment, but is not limited to this example, and one or three or more motor cases may be provided.

Portions on the tip sides of the respective motor cases 32 are disposed away from each other. Thereby, the filter support 2 can be vibrated more strongly between the positions where the respective motor cases 32 hit the filter support 2. For example, by disposing the portions on the tip sides of the motor cases 32 at one end side and the other end side of the filter 1 in the first direction D1, stronger vibration can be generated in the filter support 2 over a wider range from the one end side to the other end side of the filter 1 in the first direction D1.

Further, the motor case 32 is preferably disposed closer to the exhaust portion 302 than the filter support 2 as shown in FIG. 3. In this way, the exhaust portion 302 side of the filter support 2 can be hit by a portion on the tip side of the motor case 32, so that larger vibration can be transmitted to the exhaust side surface of the filter 1 on the exhaust portion 302 side. Since the air flows from the intake portion 301 to the exhaust portion 302 through the filter 1 by the blower 112, a larger amount of dust adheres to the intake side surface 11 of the filter 1 than to the exhaust side surface of the filter 1. Further, clogging is likely to occur on the intake side surface 11 of the filter 1. Since the motor case 32 accommodating the vibration motor 5 is disposed closer to the exhaust portion 302 than the filter support 2 in the housing 3, a larger amount of dust adhered to the intake side surface 11 of the filter 1 can be removed. Therefore, dust can be more efficiently removed from the filter 1, so that clogging and the like can be more easily eliminated.

Next, the vibration motor 5 includes a motor unit (reference numeral is omitted) and a vibrator 50 that can vibrate by the driving of the motor unit. The vibrator 50 is disposed on the tip side in the motor case 32. Therefore, the amplitude of a portion on the tip side of the motor case 32 can be further increased. In the present example embodiment, the vibration motor 5 is, for example, an eccentric motor. The vibrator 50 is an eccentric weight having a center of gravity at a position radially away from the rotation axis of the motor unit. The rotation axis of the motor unit is parallel to the direction in which the motor case 32 extends. When the motor unit rotates the eccentric weight about the rotation axis, the vibration motor 5 vibrates in a direction perpendicular to the direction in which the motor case 32 extends.

Next, the shape of the filter 1 inside the housing 3 will be described with reference to FIGS. 2 and 3. The filter 1 has a sheet shape in the present example embodiment. Therefore, the dust collector 111 can collect dust using, for example, a mesh sheet supported by the filter support 2.

The intake side surface 11 on the intake portion 301 side of the filter 1 expands in the first direction D1 perpendicular to the direction from the top surface 3*a* to the bottom surface 3*b* among the inner surfaces of the housing 3, and extends in a direction including at least a component of the second direction D2 parallel to the direction from the top surface 3*a* to the bottom surface 3*b* among the inner surfaces of the housing 3.

In the present example embodiment, the intake side surface 11 includes a top surface side region 11*a*, a bottom surface side region 11*b*, and a center region 11*c*. The top surface side region 11*a* is a region closer to the top surface 3*a* than the center region 11*c* in the second direction D2, in the intake side surface 11. The bottom surface side region 11*b* is a region closer to the bottom surface 3*b* than the center region 11*c* in the second direction D2, in the intake side surface 11. The center region 11*c* is a planar region extending from an edge on the bottom surface 3*b* side of the top surface side region 11*a* to an edge on the top surface 3*a* side of the bottom surface side region 11*b*. It is sufficient that the intake side surface 11 includes at least the top surface side region 11*a*. For example, the intake side surface 11 is not limited to the example of the present example embodiment, and may not include the center region 11*c*, or may not include the bottom surface side region 11*b* and the center region 11*c*.

The top surface side region 11*a* on the top surface 3*a* side of the intake side surface 11 of the filter 1 faces the other end of the intake passage 303 in the third direction D3 orthogonal to the first direction D1 and the second direction D2. As viewed from the first direction D1, the top surface side region 11*a* of the intake side surface 11 approaches the other end of the intake passage 303 as it approaches the top surface 3*a* side in the second direction D2. As a result, at least part of the flow of the air sucked by the intake portion 301 and sent from the other end of the intake passage 303 flows along the intake side surface 11 of the filter 1. The flow direction of such an airflow is parallel to the intake side surface 11. Therefore, the dust collected on the intake side surface 11 of the filter 1 is easily removed from the intake side surface 11 by the airflow. Therefore, accumulation of dust on the filter 1 can be suppressed.

When viewed from the first direction D1, the top surface side region 11*a* of the intake side surface 11 is preferably a curved surface having a center of curvature closer to the intake portion 301 than the intake side surface 11. For example, when viewed from the first direction D1, the top surface side region 11*a* protrudes toward the top surface 3*a* side in the second direction D2 and toward the exhaust portion 302 side in the third direction D3. Accordingly, in the top surface side region 11*a* of the intake side surface 11 of the filter 1, the airflow further easily flows along the intake side surface 11 of the filter 1. Therefore, the dust removed from the intake side surface 11 can be easily carried toward the bottom surface 3*b* of the housing 3 along the intake side surface 11 by the airflow.

Further, when viewed from the first direction D1, the radius of curvature of the top surface side region 11*a* of the intake side surface 11 increases toward the top surface 3*a* side in the second direction D2. In this way, in the top surface side region 11*a* of the intake side surface 11 of the filter 1, the inclination of the curved surface becomes gentler as it comes closer to the edge on the top surface 3*a* side of the intake side surface 11. Therefore, the airflow flowing from the other end of the intake passage 303 to the top surface side region 11*a* of the intake side surface 11 is less likely to be disturbed on the intake side surface 11 and easily flows along the intake side surface 11. Therefore, dust is more easily removed from the intake side surface 11, so that accumulation of dust on the intake side surface 11 of the filter 1 can be suppressed more effectively.

The edge on the top surface 3*a* side of the intake side surface 11 is smoothly connected to the top surface 3*a* of the housing 3. In the present example embodiment, the edge of the top surface side region 11*a* in a direction included as a component of the second direction D2 and a component of the third direction D3 is smoothly connected to the top surface 3*a* of the inner surface of the first body 311. As a result, at the connecting portion between the edge on the top surface 3*a* side of the intake side surface 11 and the top surface 3*a* of the housing 3, the two are smoothly connected without a step or the like between them. In other words, when viewed from the first direction D1, in the above-described connecting portion, the position of the top surface 3*a* in the second direction D2 is the same as the position in the second direction D2 of the edge on the top surface 3*a* side of the intake side surface 11 of the filter 1. For example, in the case of a thin mesh filter, the two are connected with smoothness so that the thickness of the filter 1 can be ignored, and their positions in the second direction D2 are the same. Also, preferably, when viewed from the first direction D1, the tangent to the top surface 3*a* in the above-described connecting portion is parallel to the tangent to the edge on the top surface 3*a* side of the intake side surface 11 of the filter 1. In this way, the airflow flowing through the intake passage 303 can smoothly flow along the intake side surface 11 without being disturbed. Therefore, accumulation of dust on the intake side surface 11 of the filter 1 can be suppressed more effectively.

In the third direction D3, the edge on the top surface 3*a* side of the intake side surface 11 is located closer to the intake portion 301 than the edge on the bottom surface 3*b* side of the intake side surface 11. In the present example embodiment, the edge of the top surface side region 11*a* in a direction having a component of the second direction D2 and a component of the third direction D3 is located closer to the intake portion 301 in the third direction D3 than the edge of the bottom surface side region 11*b* in the direction having a component of the second direction D2 and a component of the third direction D3. With this configuration, the area of the bottom surface side region 11*b* can be made smaller than the area of the top surface side region 11*a* of the intake side surface 11 of the filter 1. Therefore, an increase in the size of the filter 1 can be suppressed.

When viewed from the first direction D1, the bottom surface side region 11*b* of the intake side surface 11 is a curved surface that extends toward the intake portion 301 side in the third direction D3 as it comes closer to the bottom surface 3*b* side in the second direction D2. The center of curvature of the curved surface is located closer to the intake portion 301 than the intake side surface 11. For example, when viewed from the first direction D1, the bottom surface side region 11*b* protrudes toward the bottom surface 3*b* side in the second direction D2 and toward the exhaust portion 302 side in the third direction D3. This makes it easier for the airflow to flow along the intake side surface 11 of the filter 1 in the bottom surface side region 11*b* of the intake side surface 11 of the filter 1. Therefore, the dust removed from the intake side surface 11 by the airflow is more easily carried toward the bottom surface 3*b* of the housing 3.

The present disclosure is useful for, for example, a device that collects dust from an airflow with a filter. In a vacuum cleaner or a self-propelled vacuum cleaner having the dust collector of the present disclosure, it is possible to suppress accumulation of dust on the intake side surface of the filter.

Features of the above-described preferred example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A dust collector comprising:

a filter; and a housing that houses the filter; wherein the housing includes an intake portion, and an exhaust portion that is fluidly connected to the intake portion via the filter inside the housing;

an intake side surface on an intake portion side of the filter expands in a first direction that is perpendicular or substantially perpendicular to a direction from a top surface to a bottom surface among inner surfaces of the housing, and extends in a direction including at least a component of a second direction that is parallel or substantially parallel to the direction from the top surface to the bottom surface among the inner surfaces of the housing;

the housing includes a wall that defines an intake passage extending from the intake portion side toward a filter side;

one end of the intake passage is linked to outside of the housing via the intake portion;

another end of the intake passage opposes a top surface side region of the intake side surface of the filter in a third direction perpendicular or substantially perpendicular to the first direction and the second direction; and when viewed from the first direction, the filter extends towards the intake passage in the third direction such that the top surface side region of the intake side surface approaches the another end of the intake passage and a total distance between opposing portions of the filter and the top surface of the housing in the second direction continuously decreases as the filter extends towards the intake passage in the third direction.

2. The dust collector according to claim 1, wherein when viewed from the first direction, the top surface side region of the intake side surface is a curved surface having a center of curvature that is located closer to the intake portion than the intake side surface.

3. The dust collector according to claim 2, wherein when viewed from the first direction, a radius of curvature of the top surface side region of the intake side surface increases as the top surface side region approaches the top surface side in the second direction.

4. The dust collector according to claim 1, wherein an edge on the top surface side region of the intake side surface is connected to the top surface of the housing.

5. The dust collector according to claim 1, wherein the housing further includes a guide plate that extends from a tip portion of the wall toward the intake side surface of the filter; and when viewed from the first direction:

the guide plate is curved; and a center of curvature of the guide plate is located closer to the bottom surface of the housing than the guide plate in the second direction, and is located closer to the intake portion than the tip portion on the exhaust portion side of the guide plate in the third direction.

6. The dust collector according to claim 1, wherein in the third direction, an edge on the top surface side of the intake side surface is located closer to the intake portion than an edge on the bottom surface side of the intake side surface.

7. The dust collector according to claim 1, wherein when viewed from the first direction, a bottom surface side region of the intake side surface extends toward the intake portion side in the third direction as the bottom surface side region approaches the bottom surface side in the second direction, and the bottom surface side region is a curved surface having a center of curvature that is located closer to the intake portion than the intake side surface.

8. The dust collector according to claim 1, further comprising:

a filter support that is housed inside the housing and supports the filter; wherein the filter has a sheet shape.

9. A vacuum cleaner comprising:

a dust collector including a filter and a housing that houses the filter; and a blower that is connected to the exhaust portion and generates a flow of air from the intake portion toward the exhaust portion through the filter in the dust collector; wherein the housing includes an intake portion, and an exhaust portion that is fluidly connected to the intake portion via the filter inside the housing;

an intake side surface on an intake portion side of the filter expands in a first direction that is perpendicular or substantially perpendicular to a direction from a top surface to a bottom surface among inner surfaces of the housing, and extends in a direction including at least a component of a second direction that is parallel or substantially parallel to the direction from the to surface to the bottom surface among the inner surfaces of the housing;

the housing includes a wall that defines an intake passage extending from the intake portion side toward a filter side;

one end of the intake passage is linked to outside of the housing via the intake portion;

another end of the intake passage opposes a top surface side region of the intake side surface of the filter in a third direction perpendicular or substantially perpendicular to the first direction and the second direction; and when viewed from the first direction, the filter ends towards the intake passage in the third direction such that the top surface side region of the intake side surface approaches the another end of the intake passage and a total distance between opposing portions of the filter and the surface of the housing in the second direction continuously decreases as the filter extends towards the intake passage in the third direction.

10. A self-propelled vacuum cleaner comprising:

a dust collector including a filter and a housing that houses the filter; and a blower that is connected to the exhaust portion and generates a flow of air from the intake portion toward the exhaust portion through the filter in the dust collector; wherein the housing includes an intake portion and an exhaust portion that is fluidly connected to the intake portion via the filter the housing;

an intake side surface on an intake portion side of the filter expands in a first direction that is perpendicular or substantially perpendicular to a direction from a top surface to a bottom surface among inner surfaces of the housing and extends in a direction including at least a component of a second direction that is parallel or substantially parallel to the direction from the top surface to the bottom surface among the inner surfaces of the housing;

the housing includes a wall that defines an intake passage extending from the intake portion side toward a filter side;

one end of the intake passage is linked to outside of the housing via the intake portion;

another end of the intake passage opposes a top surface region of the intake side surface of the filter in a third direction perpendicular or substantially perpendicular to the first direction and the second direction;

when viewed from the first direction, the filter extends towards the intake passage in the third direction such that the top surface side region of the intake side surface approaches the another end of the intake passage and a total distance between opposing portions of the filter and the top surface of the housing, in the second direction continuously decreases as the filter extends towards the intake passage in the third direction; and the self-propelled vacuum cleaner is capable of performing self-propelled cleaning on a surface to be cleaned.

* * * * *